US011765522B2

(12) United States Patent
Hertzberg et al.

(10) Patent No.: US 11,765,522 B2
(45) Date of Patent: Sep. 19, 2023

(54) SPEECH-TRACKING LISTENING DEVICE

(71) Applicant: NUANCE HEARING LTD., Tel Aviv (IL)

(72) Inventors: Yehonatan Hertzberg, Shoham (IL); Yaniv Zonis, Rishon Le'zion (IL); Stanislav Berlin, Kiryat Ono (IL); Ori Goren, Shoham (IL)

(73) Assignee: NUANCE HEARING LTD., Tel Aviv (IL)

( * ) Notice: Subject to any disclaimer, the term of this patent is extended or adjusted under 35 U.S.C. 154(b) by 0 days.

(21) Appl. No.: 17/623,892

(22) PCT Filed: Jul. 21, 2020

(86) PCT No.: PCT/IB2020/056826
§ 371 (c)(1),
(2) Date: Dec. 30, 2021

(87) PCT Pub. No.: WO2021/014344
PCT Pub. Date: Jan. 28, 2021

(65) Prior Publication Data

US 2022/0417679 A1 Dec. 29, 2022

Related U.S. Application Data

(60) Provisional application No. 62/876,691, filed on Jul. 21, 2019.

(51) Int. Cl.
*H04R 25/00* (2006.01)
*H04R 1/40* (2006.01)

(52) U.S. Cl.
CPC ..... *H04R 25/407* (2013.01); *H04R 1/406* (2013.01); *H04R 25/405* (2013.01)

(58) Field of Classification Search
CPC ..... H04R 25/00; H04R 25/40; H04R 25/405; H04R 28/407; H04R 25/73
See application file for complete search history.

(56) References Cited

U.S. PATENT DOCUMENTS 3,119,903 A 1/1964 Rosemond et al.
4,904,078 A 2/1990 Gorike
(Continued)

FOREIGN PATENT DOCUMENTS

CN 205608327 U 9/2016
CN 206115061 U 4/2017
(Continued)

OTHER PUBLICATIONS

Widrow et al., "Microphone Arrays for Hearing Aids: An Overview", Speech Communication, vol. 39, pp. 139-146, year 2003.
(Continued)

*Primary Examiner* — Suhan Ni
(74) *Attorney, Agent, or Firm* — KLIGLER & ASSOCIATES PATENT ATTORNEYS LTD

(57) ABSTRACT

A system (20) includes a plurality of microphones (22), configured to generate different respective signals in response to acoustic waves (36) arriving at the microphones, and a processor (34). The processor is configured to receive the signals, to combine the signals into multiple channels, which correspond to different respective directions relative to the microphones by virtue of each channel representing any portion of the acoustic waves arriving from the corresponding direction with greater weight, relative to others of the directions, to calculate respective energy measures of the channels, to select one of the directions, in response to the energy measure for the channel corresponding to the selected direction passing one or more energy thresholds, and to output a combined signal representing the selected
(Continued)

direction with greater weight, relative to others of the directions. Other embodiments are also described.

27 Claims, 3 Drawing Sheets

(56) References Cited

U.S. PATENT DOCUMENTS

| | | | |
|---|---|---|---|
| 5,793,875 | A | 8/1998 | Lehr et al. |
| 7,031,483 | B2 | 4/2006 | Boone et al. |
| 7,099,486 | B2 | 8/2006 | Julstrom et al. |
| 7,103,192 | B2 | 9/2006 | Bailey |
| 7,369,669 | B2 | 5/2008 | Hagen et al. |
| 7,369,671 | B2 | 5/2008 | Sacha |
| 7,542,580 | B2 | 6/2009 | Burns |
| 7,609,842 | B2 | 10/2009 | Sipkema et al. |
| 7,735,996 | B2 | 6/2010 | Van Der Zwan et al. |
| 7,809,149 | B2 | 10/2010 | Burns |
| 7,822,217 | B2 | 10/2010 | Hagen et al. |
| 8,116,493 | B2 | 2/2012 | Westermann |
| 3,139,801 | A1 | 3/2012 | Sipkema et al. |
| 8,494,193 | B2 | 7/2013 | Zhang et al. |
| 8,611,554 | B2 | 12/2013 | Short et al. |
| 8,744,101 | B1 | 6/2014 | Burns |
| 9,113,245 | B2 | 8/2015 | Gelhard |
| 9,282,392 | B2 | 3/2016 | Ushakov |
| 9,288,589 | B2 | 3/2016 | Cheung |
| 9,392,381 | B1 | 7/2016 | Park et al. |
| 9,591,410 | B2 | 3/2017 | Short et al. |
| 9,635,474 | B2 | 4/2017 | Kuster |
| 9,641,942 | B2 | 5/2017 | Strelcyk et al. |
| 9,763,016 | B2 | 9/2017 | Merks et al. |
| 9,781,523 | B2 | 10/2017 | Kuster et al. |
| 9,812,116 | B2 | 11/2017 | Ushakov |
| 9,980,054 | B2 | 5/2018 | McCracken |
| 10,102,850 | B1 | 10/2018 | Basye et al. |
| 10,225,670 | B2 | 3/2019 | Feilner et al. |
| 10,231,065 | B2 | 3/2019 | Udesen |
| 10,353,221 | B1 | 7/2019 | Graff et al. |
| D865,040 | S | 10/2019 | Schaal et al. |
| D874,008 | S | 1/2020 | Kotzer et al. |
| 10,567,888 | B2 | 2/2020 | Hertzberg et al. |
| 10,582,295 | B1 | 3/2020 | Zhong et al. |
| 10,721,572 | B2 | 7/2020 | Petersen et al. |
| 10,805,739 | B2 | 10/2020 | Sjursen |
| 2004/0076301 | A1 | 4/2004 | Algazi et al. |
| 2006/0013416 | A1 | 1/2006 | Truong et al. |
| 2007/0038442 | A1 | 2/2007 | Visser et al. |
| 2008/0192968 | A1 | 8/2008 | Ho et al. |
| 2009/0323973 | A1 | 12/2009 | Dyba |
| 2011/0091057 | A1 | 4/2011 | Derkx et al. |
| 2011/0293129 | A1 | 12/2011 | Dillen et al. |
| 2012/0128175 | A1 | 5/2012 | Visser et al. |
| 2012/0215519 | A1* | 8/2012 | Park ..... H04R 3/005 381/17 |
| 2012/0224715 | A1 | 9/2012 | Kikker |
| 2014/0093091 | A1 | 4/2014 | Dusan et al. |
| 2014/0093093 | A1 | 4/2014 | Dusan et al. |
| 2014/0270316 | A1 | 9/2014 | Kopina et al. |
| 2015/0036856 | A1 | 2/2015 | Pruthi et al. |
| 2015/0049892 | A1 | 2/2015 | Petersen et al. |
| 2015/0201271 | A1 | 7/2015 | Diethorn et al. |
| 2015/0230026 | A1 | 8/2015 | Eichfeld et al. |
| 2015/0289064 | A1 | 10/2015 | Jensen et al. |
| 2016/0111113 | A1 | 4/2016 | Cho et al. |
| 2017/0272867 | A1 | 9/2017 | Zisapel et al. |
| 2018/0146285 | A1 | 5/2018 | Benattar et al. |
| 2018/0330747 | A1 | 11/2018 | Ebenezer |
| 2018/0359294 | A1 | 12/2018 | Brown et al. |
| 2019/0104370 | A1 | 4/2019 | Zisapel et al. |
| 2019/0373355 | A1 | 12/2019 | Lee et al. |
| 2020/0005770 | A1* | 1/2020 | Lunner ..... G10L 15/16 |

FOREIGN PATENT DOCUMENTS

| | | | |
|---|---|---|---|
| CN | 206920741 | U | 1/2018 |
| CN | 207037261 | U | 2/2018 |
| CN | 208314369 | U | 1/2019 |
| CN | 208351162 | U | 1/2019 |
| CN | 209693024 | U | 11/2019 |
| CN | 209803482 | U | 12/2019 |
| ES | 1213304 | U | 5/2018 |
| KR | 20130054898 | A | 5/2013 |
| KR | 101786613 | B1 | 10/2017 |
| KR | 102006414 | B1 | 8/2019 |
| WO | 9960822 | A1 | 11/1999 |
| WO | 2004016037 | A1 | 2/2004 |
| WO | 2013169618 | A1 | 11/2013 |
| WO | 2017158507 | A1 | 9/2017 |
| WO | 2017171137 | A1 | 10/2017 |
| WO | 2018127412 | A1 | 7/2018 |
| WO | 2018234628 | A1 | 12/2018 |

OTHER PUBLICATIONS

Bose Hearphones™, "Hear Better", pp. 1-3, Feb. 19, 2017.
Veen et al., "Beamforming Techniques for Spatial Filtering", CRC Press, pp. 1-23, year 1999.
"iCE40 Series MobileFPGA Family," Product Information, Lattice Semiconductor, Santa Clara, Calif., pp. 1-2, last updated May 13, 2021, as downloaded from https://www.mouser.co.il/new/lattice-semiconductor/lattice-ice40-FPGA/.
Choi et al., "Blind Source Separation and Independent Component Analysis: A Review," Neural Information Processing—Letters and Review, vol. 6, No. 1, pp. 1-57, year 2005.
Mukai et al., "Real-Time Blind Source Separation and DOA Estimation Using Small 3-D Microphone Array," Proceedings of the International Workshop on Acoustic Echo and Noise Control (IWAENC), pp. 45-48, year 2005.
Huang et al., "Real-Time Passive Source Localization: A Practical Linear-Correction Least-Squares Approach," IEEE Transactions on Speech and Audio Processing, vol. 9, No. 8, pp. 943-956, year 2001.
Sawada et al., "Direction of Arrival Estimation for Multiple Source Signals Using Independent Component Analysis," EEE Proceedings of the Seventh International Symposium on Signal Processing and its Applications, vol. 2, pp. 1-4, year 2003.
Adavanne et al., "Direction of Arrival Estimation for Multiple Sound Sources Using Convolutional Recurrent Neural Network," 26th European Signal Processing Conference (EUSIPCO), IEEE, pp. 1462-1466, year 2018.
Byrne et al., "An International Comparison of Long-Term Average Speech Spectra," The Journal of the Acoustical Society of America, vol. 96, No. 4, pp. 2108-2120, year 1994.
Wikipedia, "Direction of Arrival," pp. 1-2, last edited Nov. 15, 2020.
DiBiase, "A High-Accuracy, Low-Latency Technique for Talker Localization in Reverberant Environments Using Microphone Arrays," Doctoral Thesis, Division of Engineering, Brown University, Providence, Rhode Island, pp. 1-122, year 2000.
International Application # PCT/IB2020/056826 Search Report dated Nov. 17, 2020.
AU Application # 2020316738 Office Action dated Dec. 16, 2022.
EP Application # 20844216.0 ESR dated Jun. 29, 2023.

* cited by examiner

SPEECH-TRACKING LISTENING DEVICE

CROSS-REFERENCE TO RELATED APPLICATIONS

The present application claims the benefit of U.S. Provisional Application 62/876,691, entitled "Automatic determination of listening direction," filed Jul. 21, 2019, whose disclosure is incorporated herein by reference.

FIELD OF THE INVENTION

The present invention relates to listening devices comprising microphone arrays, such as directional hearing aids.

BACKGROUND

Speech understanding in noisy environments is a significant problem for the hearing-impaired. Hearing impairment is usually accompanied by a reduced time resolution of the sensorial system in addition to a gain loss. These characteristics further reduce the ability of the hearing-impaired to filter the target source from the background noise and particularly to understand speech in noisy environments.

Some newer hearing aids offer a directional hearing mode to improve speech intelligibility in noisy environments. This mode makes use of multiple microphones and applies beamforming technology to combine inputs from the microphones into a single, directional audio output channel. The output channel has spatial characteristics that increase the contribution of acoustic waves arriving from the target direction relative to those of the acoustic waves from other directions. Widrow and Luo survey the theory and practice of directional hearing aids in "Microphone arrays for hearing aids: An overview," Speech Communication 39 (2003), pages 139-146, which is incorporated herein by reference.

US Patent Application Publication 2019/0104370, whose disclosure is incorporated herein by reference, describes a hearing aid apparatus including a case, which is configured to be physically fixed to a mobile telephone. An array of microphones are spaced apart within the case and are configured to produce electrical signals in response to acoustical inputs to the microphones. An interface is fixed within the case. Processing circuitry is fixed within the case and is coupled to receive and process the electrical signals from the microphones so as to generate a combined signal for output via the interface.

U.S. Pat. No. 10,567,888, whose disclosure is incorporated herein by reference, describes an audio apparatus including a neckband, which is sized and shaped to be worn around a neck of a human subject and includes left and right sides that rest respectively above the left and right clavicles of the human subject wearing the neckband. First and second arrays of microphones are disposed respectively on the left and right sides of the neckband and configured to produce respective electrical signals in response to acoustical inputs to the microphones. One or more earphones are worn in the ears of the human subject. Processing circuitry is coupled to receive and mix the electrical signals from the microphones in the first and second arrays in accordance with a specified directional response relative to the neckband so as to generate a combined audio signal for output via the one or more earphones.

SUMMARY OF THE INVENTION

There is provided, in accordance with some embodiments of the present invention, a system including a plurality of microphones, configured to generate different respective signals in response to acoustic waves arriving at the microphones, and a processor. The processor is configured to receive the signals and to combine the signals into multiple channels, which correspond to different respective directions relative to the microphones by virtue of each channel representing any portion of the acoustic waves arriving from the corresponding direction with greater weight, relative to others of the directions. The processor is further configured to calculate respective energy measures of the channels, to select one of the directions, in response to the energy measure for the channel corresponding to the selected direction passing one or more energy thresholds, and to output a combined signal representing the selected direction with greater weight, relative to others of the directions.

In some embodiments, the combined signal is the channel corresponding to the selected direction.

In some embodiments, the processor is further configured to indicate the selected direction to a user of the system.

In some embodiments, the processor is further configured to calculate one or more speech-similarity scores for one or more of the channels, respectively, each of the speech-similarity scores quantifying a degree to which a different respective one of the channels appears to represent speech, and the processor is configured to select the one of the directions in response to the speech-similarity scores.

In some embodiments, the processor is configured to calculate each of the speech-similarity scores by correlating first coefficients, which represent a spectral envelope of one of the channels, with second coefficients, which represent a canonical speech spectral envelope.

In some embodiments, the processor is configured to combine the signals into the multiple channels using blind source separation (BSS).

In some embodiments, the processor is configured to combine the signals into the multiple channels in accordance with multiple directional responses oriented in the directions, respectively.

In some embodiments, the processor is further configured to identify the directions using a direction-of-arrival (DOA) identifying technique.

In some embodiments, the directions are predefined.

In some embodiments, the energy measures are based on respective time-averaged acoustic energies of the channels, respectively, over a period of time.

In some embodiments, the time-averaged acoustic energies are first time-averaged acoustic energies, the processor is configured to receive the signals while outputting another combined signal corresponding to another one of the directions, and at least one of the energy thresholds is based on a second time-averaged acoustic energy of the channel corresponding to the other one of the directions, the second time-averaged acoustic energy giving greater weight to earlier portions of the period of time relative to the first time-averaged acoustic energies.

In some embodiments, at least one of the energy thresholds is based on an average of the time-averaged, acoustic energies.

In some embodiments, the time-averaged acoustic energies are first time-averaged, acoustic energies, the processor is further configured to calculate respective second time-averaged acoustic energies of the channels over the period of time, the second time-averaged acoustic energies giving greater weight to earlier portions of the period of time, relative to the first time-averaged acoustic energies, and at least one of the energy thresholds is based on an average of the second time-averaged acoustic energies.

In some embodiments, the selected direction is a first selected direction and the combined signal is a first combined signal, and the processor is further configured to:

select a second one of the directions, and output, instead of the first combined signal, a second combined signal representing both the first selected direction and the second selected direction with greater weight, relative to others of the directions.

In some embodiments, the processor is further configured to:

select a third one of the directions, ascertain that the second selected, direction is more similar e third selected direction than is the first selected direction, and output, instead of the second combined signal, a third combined signal representing both the first selected direction and the third selected direction with greater weight, relative to others of the directions.

There is further provided, in accordance with some embodiments of the present invention, a method including receiving, by a processor, a plurality of signals from different respective microphones, the signals being generated by the microphones in response to acoustic waves arriving at the microphones. The method further includes combining the signals into multiple channels, which correspond to different respective directions relative to the microphones by virtue of each channel representing any portion of the acoustic waves arriving from the corresponding direction with greater weight, relative to others of the directions. The method further includes calculating respective energy measures of the channels, selecting one of the directions, in response to the energy measure for the channel corresponding to the selected direction passing one or more energy thresholds, and outputting a combined signal representing the selected direction with greater weight, relative to others of the directions.

There is further provided, in accordance with some embodiments of the present invention, a computer software product including a tangible non-transitory computer-readable medium in which program instructions are stored. The instructions, when read by a processor, cause the processor to receive, from a plurality of microphones, respective signals generated by the microphones in response to acoustic waves arriving at the microphones, and to combine the signals into multiple channels, which correspond to different respective directions relative to the microphones by virtue of each channel representing any portion of the acoustic waves arriving from the corresponding direction with greater weight, relative to others of the directions. The instructions further cause the processor to calculate respective energy measures of the channels, to select one of the directions, in response to the energy measure for the channel corresponding to the selected direction passing one or more energy thresholds, and to output a combined signal representing the selected direction with greater weight, relative to others of the directions.

The present invention will be more fully understood from the following detailed description of embodiments thereof, taken together with the drawings, in which:

DETAILED DESCRIPTION OF EMBODIMENTS

Overview

Embodiments of the present invention include a listening device for tracking speech. The listening device may function as a hearing aid for a hearing-impaired user, by amplifying speech over other sources of noise. Alternatively, the listening device may function as a "smart" microphone in a conference room or any other setting in which a speaker may be speaking in the presence of other noise.

The listening device comprises an array of microphones, each of which is configured to output a respective audio signal in response to received acoustic waves. The listening device further comprises a processor, configured to combine the audio signals into multiple channels corresponding to different respective directions from which the acoustic waves are arriving at the listening device. Subsequently to generating the channels, the processor selects the channel that is most likely to represent speech, rather than other noise. For example, the processor may calculate respective energy measures for the channels, and then select the channel having the highest energy measure. Optionally, the processor may require that the spectral envelope of the selected channel be sufficiently similar to the spectral envelope of a canonical speech signal. Subsequently to selecting the channel, the processor outputs the selected channel.

In some embodiments, the processor uses blind source separation (BSS) techniques to generate the channels, such that the processor need not necessarily identify any of the directions to which the channels correspond. In other embodiments, the processor uses a direction-of-arrival (DOA) identifying technique to identify the primary directions from which the acoustic waves are arriving, and then generates the channels by combining the signals in accordance with multiple different directional responses oriented in the identified directions, respectively. In yet other embodiments, the processor generates the channels by combining the signals in accordance with multiple directional responses oriented in different respective predefined directions.

Typically, the listening device is not redirected to a new channel unless the time-averaged amount of acoustic energy of the channel over a period of time exceeds one or more thresholds. By virtue of comparing the time-averaged energy to the thresholds, occurrences in which the listening device performs a spurious or premature redirection away from a speaker are reduced. The thresholds may include, for example, a multiple of a time-averaged amount of acoustic energy of the channel that is currently being output from the listening device.

Embodiments of the present invention further provide techniques for alternating between a single listening direction and multiple listening directions, so as to seamlessly follow conversations in which multiple speakers may speak simultaneously on occasion.

System Description

Figure 1:
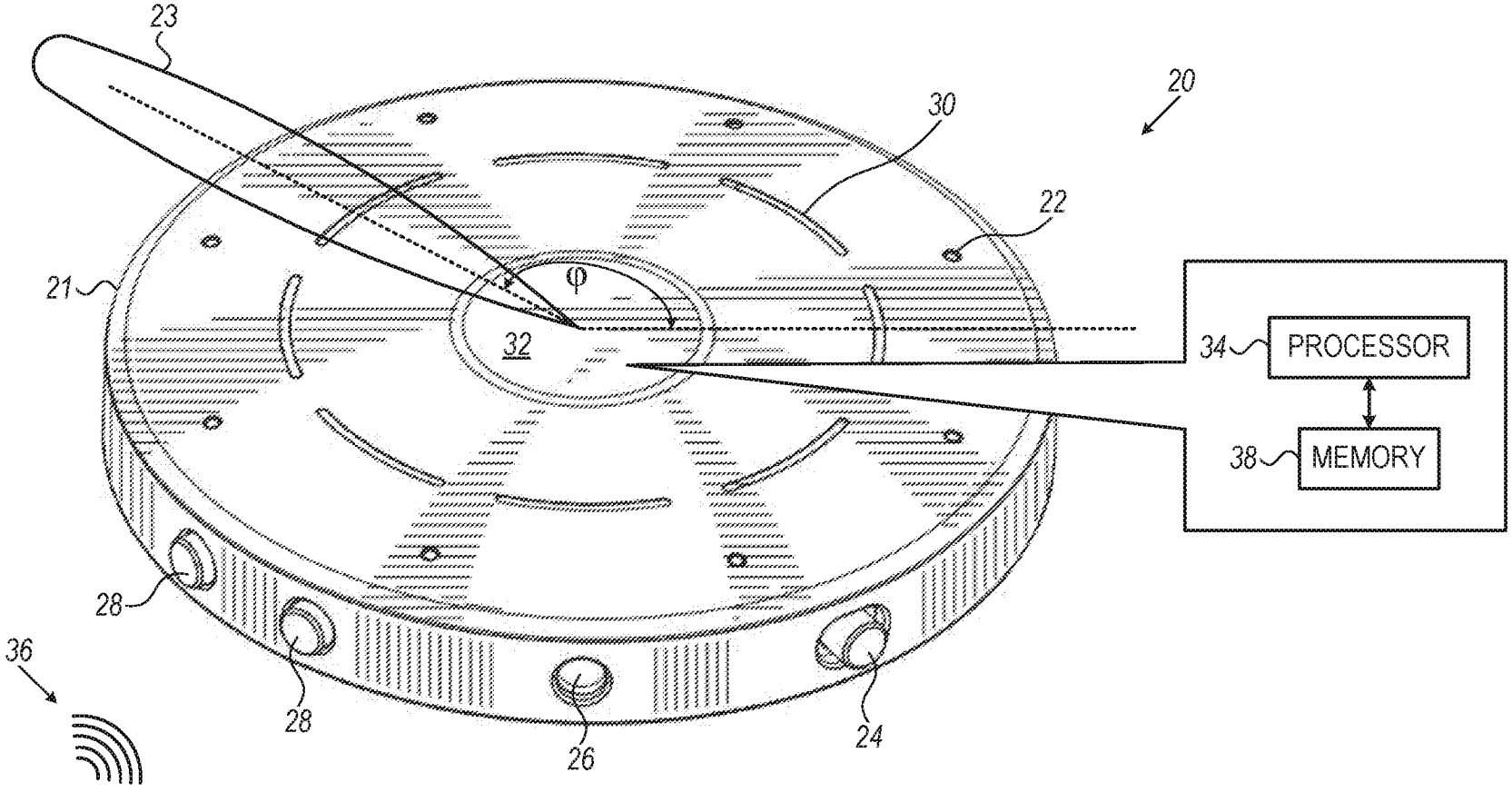
FIG. 1 is a schematic illustration of a speech-tracking listening device, in accordance with some embodiments of the present invention.

Reference is initially made to FIG. 1, which is a schematic illustration of a speech-tracking listening device 20, in accordance with some embodiments of the present invention.

Listening device 20 comprises multiple (e.g., four, eight, or more) microphones 22, each of which may comprise any suitable type of acoustic transducer known in the art, such as a microelectromechanical system (MEMS) device or miniature piezoelectric transducer. (The term "acoustic transducer" is used broadly, in the context of the present patent application, to refer to any device that converts acoustic waves into an electrical signal, or vice versa.) Microphones 22 are configured to receive (or "detect") acoustic waves 36 and, in response to the acoustic waves, generate signals, referred to herein as "audio signals," representing the time-varying amplitude of acoustic waves 36.

In some embodiments, as shown in FIG. 1, microphones 22 are arranged in a circular array. In other embodiments, the microphones are arranged in a linear array or in any other suitable arrangement. In any case, by virtue of the microphones having different respective positions, the microphones detect acoustic waves 36 with different respective delays, thus facilitating the speech-tracking functionality of listening device 20 as described herein.

By way of example, FIG. 1 shows listening device 20 comprising a pod 21, around the circumference of which microphones 22 are arranged. Pod 21 may comprise a power button 24, volume buttons 28, and/or indicator lights 30 for indicating volume, battery status, current listening direction(s), and/or other relevant information. Pod 21 may further comprise a button. 32 for toggling the speech-tracking functionality described herein, and/or any other suitable interfaces or controls.

Typically, the pod further comprises a communication interface. For example, the pod may comprise an audio jack 26 and/or a Universal Serial Bus (USB) jack (not shown) for connecting headphones or earphones to the pod, such that a user may listen to the signal output by the pod (as described in detail below) via the headphones or earphones. (Thus, the listening device may function as a hearing aid.) Alternatively or additionally, the pod may comprise a network interface (not shown) for communicating the output signal over a computer network (e.g., the Internet), telephone network, or any other suitable communication network. (Thus, the listening device may function as a smart microphone for conference rooms and other similar settings.) Pod 21 is generally used while sitting on a table or another surface.

Alternatively to pod 21, listening device 20 may comprise any other suitable apparatus comprising any of the components described above. For example, the listening device may comprise a mobile-phone case, as described in US Patent Application Publication 2019/0104370, whose disclosure is incorporated herein by reference, a neckband, as described in U.S. Pat. No. 10,567,888, whose disclosure is incorporated herein by reference, a spectacle frame, a closed necklace, a belt, or an implement that is clipped to or embedded in the user's clothing. For each of these devices, the relative positions of the microphones are generally fixed, i.e., the microphones do not move relative to each other while the listening device is in use.

Listening device 20 further comprises a processor 34 and a memory 38, which typically comprises a high-speed nonvolatile memory array, such as a flash memory. In some embodiments, the processor and memory are implemented in single integrated circuit chip contained within the apparatus comprising the microphones, such as within pod 21, or externally to the apparatus, e.g., within headphones or earphones connected to the device. Alternatively, the processor and/or memory may be distributed over multiple chips, some of which may be located externally to the apparatus.

As described in detail below, by processing the audio signals received from the microphones, processor 34 generates an output signal—referred to hereinbelow as a "combined signal"—in which the audio signals are combined so as to represent the portion of the acoustic waves having the greatest amount of energy with greater weight, relative to other portions of the acoustic waves. Typically, the former are produced by a speaker, while the latter are produced by sources of noise; thus, the listening device is described herein as a "speech-tracking" listening device. As described above, the output signal may be output (in digital or analog form) from the listening device via any suitable communication interface.

In some embodiments, the processor generates the combined signal by applying any suitable blind source separation technique to the audio signals. In such embodiments, the processor need not necessarily identify the direction from which the most energetic portion of the acoustic waves is arriving at the listening device.

In other embodiments, the processor generates the combined signal by applying suitable beamforming coefficients to the audio signals so as to time-shift the signals, gain-adjust the various frequency bands of the signals, and then sum the signals, all this being done in accordance with a particular directional response. In some embodiments, this computation is performed in the frequency domain, by multiplying the respective Fast Fourier Transforms (FFTs) of the (digitized) audio signals by appropriate beam-forming coefficients, summing the FFTs, and then computing the combined signal as the inverse FFT of the sum. In other embodiments, this computation is performed. In the time domain, by applying, to the audio signals, the finite impulse response (FIR) filter of suitable beamforming coefficients. In any case, the combined signal is generated so as to increase the contribution of acoustic waves arriving from a target direction, relative to the contribution of acoustic waves arriving from other directions.

In some such embodiments, the direction which the directional response is oriented is defined by a pair of angles, including an azimuthal angle $\varphi$ and a polar angle, in a coordinate system of the listening device. (The origin of the coordinate system may be located, for example, at a point that is equidistant to each of the microphones.) In other such embodiments, for ease of computation, differences in elevation are ignored, such that the direction is defined by an azimuthal angle $\varphi$ for all elevations. In any case, by combining the audio signals in accordance with the directional response, the processor effectively forms a listening beam 23 oriented in the direction, such that the combined signal gives greater representation to acoustic waves originating within listening beam 23, relative to acoustic waves originating outside listening beam 23. (Listening beam 23 may have any suitable width.)

In some embodiments, the microphones output the audio signals in analog form. In such embodiments, processor 34 comprises an analog/digital (A/D) converter, which digitizes the audio signals. Alternatively, the microphones may output the audio signals in digital form, by virtue of A/D conversion circuitry integrated into the microphones. Even in such embodiments, however, the processor may comprise an A/D converter for converting the aforementioned combined signal to analog form, for output via an analog communication interface. (It is noted that in the context of the present application, including the claims, the same term may be used to refer to a particular signal in both its analog form and its digital form.)

Typically, processor 34 further comprises processing circuitry, such as a digital signal processor (DSP) or field programmable gate array (FPGA), for combining the audio signals. An example embodiment of suitable processing circuitry is the iCE40 FPGA by Lattice Semiconductor, Santa Clara, Calif.

Alternatively or additionally to the aforementioned circuitry, processor 34 may comprise a microprocessor, which is programmed in software or firmware to carry out at least some of the functions described herein. Such a microprocessor may comprise at least a central processing unit (CPU) and random access memory (RAM). Program code, including software programs, and/or data are loaded into the RAM for execution and processing by the CPU. The program code and/or data may be downloaded to the processor in electronic form, over a network, for example. Alternatively or additionally, the program code and/or data may be provided and/or stored on non-transitory tangible media, such as magnetic, optical, or electronic memory. Such program code and/or data, when provided to the processor, produce a machine or special-purpose computer, configured to perform the tasks described herein.

In some embodiments, memory 38 stores multiple sets of beamforming coefficients corresponding to different respective predefined directions, and the listening device always listens in one of the predefined directions when performing directional hearing. In general, any suitable number of directions may be predefined. As a purely illustrative example, eight directions, corresponding to azimuthal angles of 0, 45, 90, 135, 180, 225, 270, and 315 degrees in the coordinate system of the listening device, may be predefined, and memory 38 may thus store eight corresponding sets of beamforming coefficients. In other embodiments, the processor calculates at least some sets of beamforming coefficients on the fly, such that the listening device may listen in any direction.

In general, the beamforming coefficients may be calculated—in advance of being stored in memory 38, or on the fly by the processor—using any suitable algorithm known in the art, such as any of the algorithms described in the above-mentioned article by Widrow and Luo. One specific example is a time delay (or delay-and-sum (DAS)) algorithm, which, for any particular direction, computes beamforming coefficients so as to combine the audio signals with time shifts equal to the propagation times of the acoustic waves between the microphone locations with respect to the particular direction. Other examples include Minimum Variance Distortionless Response (MVDR), Linear Constraint Minimum Variance (LCMV), General Sidelobe Canceller (GSC), and Broadband Constrained Minimum Variance (BCMV). Such beamforming algorithms, as well as other audio enhancement functions that can be applied by processor 34, are further described in the above-mentioned PCT International Publication WO 2017/158507.

It is noted that a set of beamforming coefficients de multiple subsets of coefficients for different respective frequency bands.

Source Tracking

Figure 2:
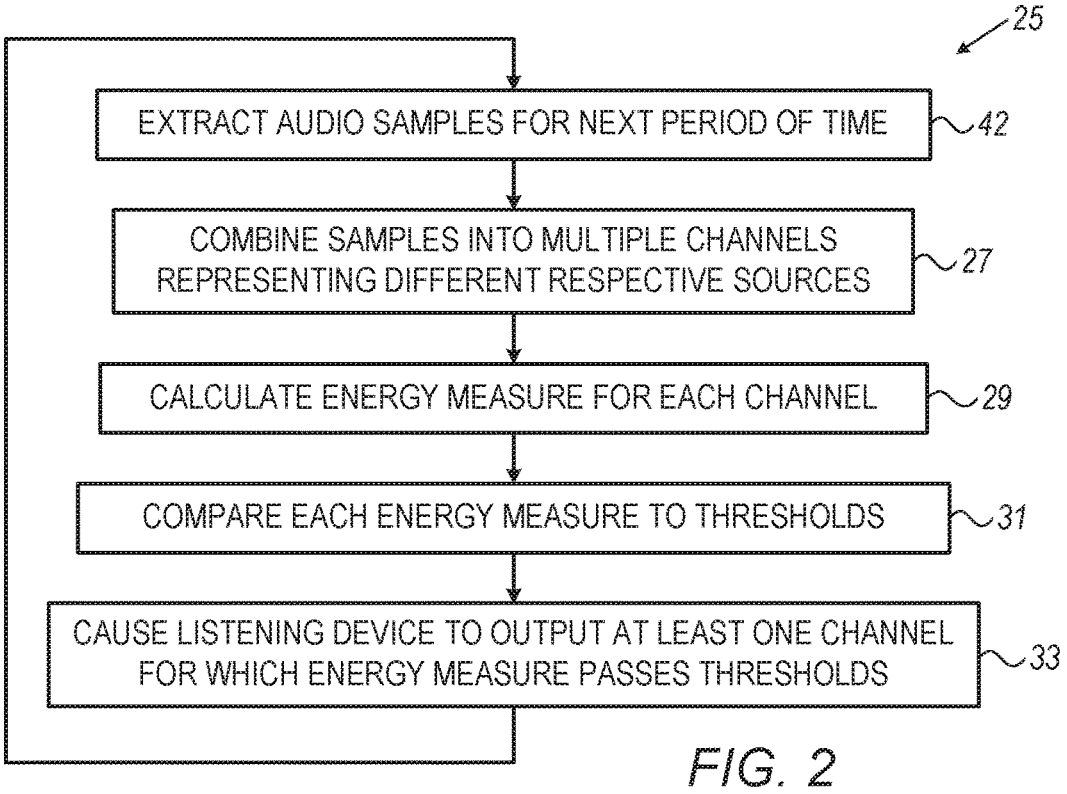
FIG. 2 is a flow diagram for an example algorithm tracking source of speech, in accordance with some embodiments of the present invention.

Reference is now made to FIG. 2, which a flow diagram for an example algorithm 25 for tracking a source of speech, in accordance with some embodiments of the present invention. As the audio signals are continually received from the microphones, processor 34 repeatedly iterates through algorithm 25.

Each iteration of algorithm 25 begins at a sample-extracting step 42, at which a respective sequence of samples is extracted from each audio signal. Each sequence of samples may span, for example, 2-10 ms.

Subsequently to extracting the samples, the processor, at a signal-combining step 27, combines the signals—in particular, the respective sequences of samples extracted from the signals into multiple channels. The channels correspond to different respective directions relative to the listening device (or relative to the microphones) by virtue of each channel representing any portion of the acoustic waves arriving from the corresponding direction with greater weight, relative to other directions. However, the processor does not identify the directions; rather, the processor uses a blind source separation (BSS) technique to generate the channels.

In general, the processor may use any suitable BSS technique. One such technique, which applies independent component analysis (ICA) to the audio signals, is described in Choi, Seungjin, et al., "Blind source separation and independent component analysis: A review," Neural Information Processing-Letters and Reviews 6.1 (2005): 1-57, which is incorporated herein by reference. Other such techniques may similarly use ICA; alternatively, they may apply principal component analysis (PCA) or neural networks to the audio signals.

Subsequently, for each channel, the processor calculates a respective energy measure at a first energy-measure-calculating step 29, and then compares the energy measure to one or more energy thresholds at an energy-measure-comparing step 31. Further details regarding these steps are provided below, in the subsection entitled "Calculating the energy measures and thresholds."

Subsequently, at a channel-outputting step 33, the processor causes the listening device to output at least one channel for which the energy measure passes the thresholds. In other words, the processor outputs the channel to a communication interface of the listening device, such that the listening device outputs the channel via the communication interface.

In some embodiments, the listening device outputs only those channels that appear to represent speech. For example, subsequently to ascertaining that the energy measure of a particular channel passes the thresholds, the processor may apply a neural network or any other machine-learned model to the channel. The model may ascertain that the channel represents speech in response to the degree to which features of the channel, such as frequencies of the channel, are indicative of speech content. Alternatively, the processor may calculate a speech-similarity score for the channel, the score quantifying the degree to which the channel appears to represent speech, and then compare the score to a suitable threshold. The score may be calculated, for example, by correlating coefficients representing the spectral envelope of the channel with other coefficients representing a canonical speech spectral envelope, which represents the average spectral properties of speech in a particular language (and, optionally, dialect). Further details regarding this calculation are provided, below, in the subsection entitled "Calculating the speech-similarity score."

In some embodiments, subsequently to selecting a channel for output, the processor identifies the direction corresponding to the selected channel. For example, for embodiments in which an ICA technique is used for BSS, the processor may calculate the direction from particular interim output of the technique, known as the "separation matrix," and the respective locations of the microphones, as described, for example, in Mukai, Ryo, et al., "Real-time blind source separation and DOA estimation using small 3-D microphone array," Proc. Int. Workshop on Acoustic Echo and Noise Control (IWAENC), 2005, whose disclosure is incorporated herein by reference. Subsequently, the processor may indicate the direction to the user(s) of the listening device, as described at the end of the present description.

Directional Hearing

Figure 3:
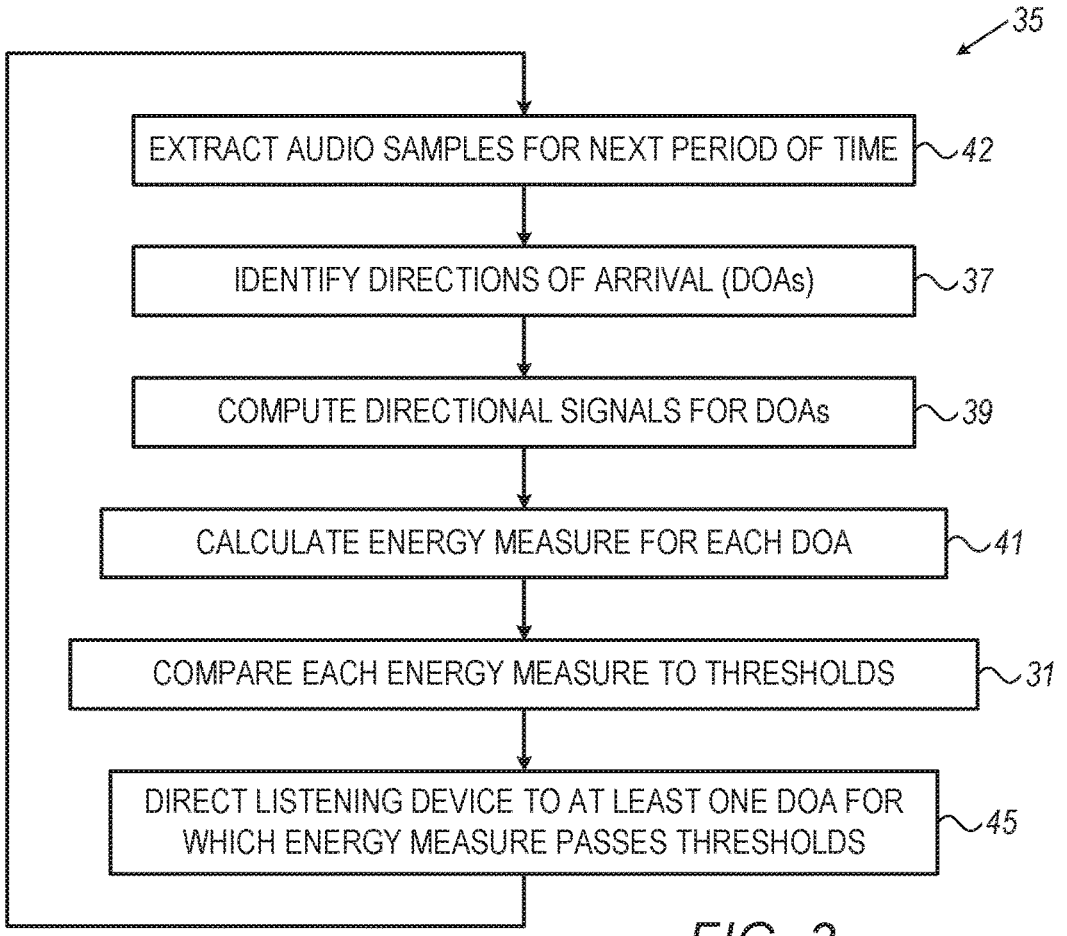
FIG. 3 is a flow diagram for an example algorithm for tracking speech via directional hearing, in accordance with some embodiments of the present invention.

Reference is now made to FIG. 3, which is a flow diagram for an example algorithm 35 for tracking speech via directional hearing, in accordance with some embodiments of the present invention. As the audio signals are continually received from the microphones, processor 34 repeatedly iterates through algorithm 35.

By way of introduction, it is noted that algorithm 35 differs from algorithm 25 (FIG. 2) in that, in the case of algorithm 35, the processor identifies the respective directions to which the channels correspond. Thus, in the description of algorithm 35 below, the channels are referred to as "directional signals."

Each iteration of algorithm 35 begins with sample-extracting step 42, as described above with reference to FIG. 2. Following sample-extracting step 42, the processor performs a DOA-identifying step 37 at which the processor identifies the DOAs of the acoustic waves.

In performing DOA-identifying step 37, the processor may use any suitable DOA-identifying technique known in the art. One such technique, which identifies DOAs by correlating between the audio signals, is described in Huang, Yiteng, et al., "Real-time passive source localization: A practical linear-correction least-squares approach," IEEE transactions on Speech and Audio Processing 9.8 (2001): 943-956, which is incorporated herein by reference, Another such technique, which applies ICA to the audio signals, is described in Sawada, Hiroshi et al., "Direction of arrival estimation for multiple source signals using independent component analysis," Seventh International Symposium on Signal Processing and Its Applications, 2003 Proceedings, Vol. 2, IEEE, 2003, which is incorporated herein by reference. Yet another such technique, which applies a neural network to the audio signals, is described in Adavanne, Sharath et al., "Direction of arrival estimation for multiple sound sources using convolutional recurrent neural network," 2018 26th European Signal Processing Conference (EUSIPCO), IEEE, 2018, which is incorporated herein by reference.

Subsequently, the processor, at a first directional-signal-computing step 39, computes respective directional signals for the identified DOAs. In other words, for each DOA, the processor combines the audio signals in accordance with a directional response oriented in the DOA, so as to generate a directional signal giving greater representation to sound arriving from the DOA, relative to other directions. In performing this functionality, the processor may calculate suitable beamforming coefficients on the fly, as described above with reference to FIG. 1.

Next, at a second energy-measure-calculating step 41, the processor calculates a respective energy measure for each DOA (i.e., for each directional signal). The processor then compares each energy measure to one or more energy thresholds at energy-measure-comparing step 31. As noted above with reference to FIG. 2, further details regarding these steps are provided below, in the subsection entitled "Calculating the energy measures and thresholds."

Finally, at a first directing step 45, the processor directs the listening device to at least one DOA for which the energy measure passes the thresholds. For example, the processor may cause the listening device to output the directional signal, computed at first directional-signal-computing step 39, that corresponds to the DOA. Alternatively, the processor may use different beamforming coefficients to generate, for output by the listening device, another combined signal having a directional response oriented in the DOA.

As described above with reference to FIG. 2, the processor may require that any output signal appear to represent speech.

Directional Hearing in One or More Predefined Directions

An advantage of the aforementioned directional-hearing embodiments is that the directional response of the listening device may be oriented in any direction. In some embodiments, however, to reduce the computational load on the processor, the processor selects one of multiple predefined directions, and then orients the directional response of the listening device in the selected direction.

In such embodiments, the processor first generates multiple channels (again referred to as "directional signals") $\{X_n\}$, n=1 . . . N, where N is the number of predefined directions. Each directional signal gives greater representation to sound arriving from a different respective one of the predefined directions.

Subsequently, the processor calculates respective energy measures for the directional signals, e.g., as further described below in the subsection entitled "Calculating the energy measures and thresholds." The processor may further calculate one or more speech-similarity scores for one or more of the directional signals, e.g., as further described below in the subsection entitled "Calculating the speech-similarity score." Subsequently, based on the energy measures and, optionally, the speech-similarity scores, the processor selects at least one of the predefined directions for the directional response of the listening device. The processor may then cause the listening device to output the directional signal corresponding to the selected predefined direction; alternatively, the processor may use different beamforming coefficients to generate, for output by the listening device, another signal having the directional response oriented in the selected predefined direction.

In some embodiments, the processor calculates a respective speech-similarity score for each of the directional signals. Subsequently, the processor computes respective speech-energy measures for the directional signals, based on the energy measures and the speech-similarity scores. For example, given a convention in which a higher energy measure indicates greater energy and a higher speech-similarity score indicates greater similarity to speech, the processor may calculate each speech-energy measure by multiplying the energy measure by the speech-similarity score. The processor may then select one of the predefined directions in response to the speech-energy measure for the direction passing one or more predefined speech-energy thresholds.

In other embodiments, the processor calculates a speech-similarity score for a single one of the directional signals, such as the directional signal having the highest energy measure or the directional signal corresponding to a current listening direction. Subsequently to calculating the speech-similarity score, the processor compares the speech-similarity score to a predefined speech-similarity threshold, and also compares each of the energy measures with one or more predefined energy thresholds. If the speech-similarity score passes the speech-similarity threshold, the processor may select, for the directional response of the listening device, at least one of the directions for which the energy measure passes the energy thresholds.

As yet another alternative, the processor may first identify the directional signals whose respective energy measures pass the energy thresholds. Subsequently, the processor may ascertain whether at least one of these signals represents speech, e.g., based on a speech-similarity score or machine-learned model, as described above with reference to FIG. 2. For each of these signals that represents speech, the processor may direct the listening device to the corresponding direction.

Figure 4:
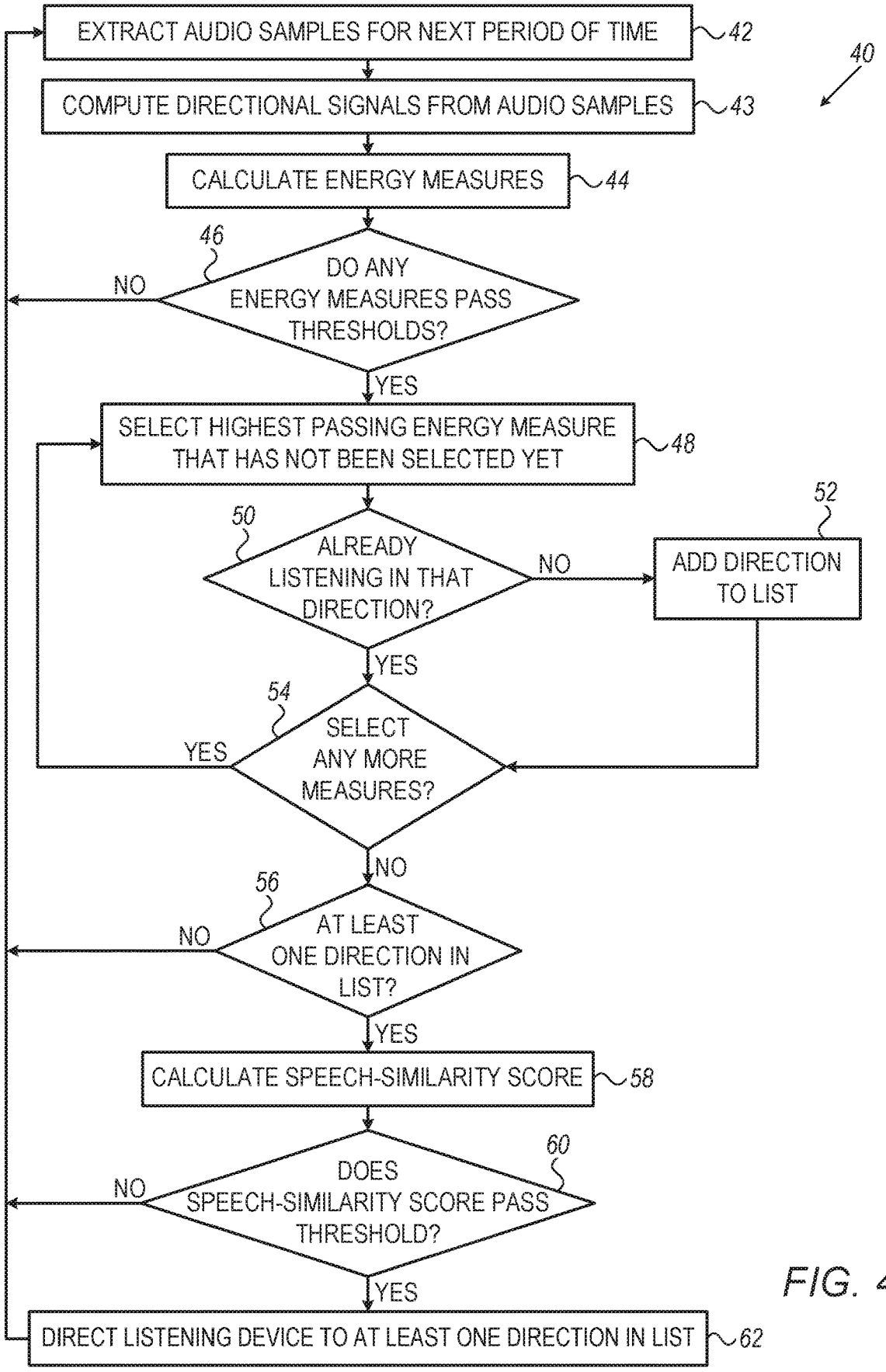
FIG. 4 is a flow diagram for an example algorithm for directional hearing in one or more predefined directions, in accordance with some embodiments of the present invention.

For further details, reference is now made to FIG. 4, which is a flow diagram for an example algorithm 40 for directional hearing in one or more predefined directions, in accordance with some embodiments of the present invention. As the audio signals are continually received from the microphones, processor 34 repeatedly iterates through algorithm 40.

Each iteration of algorithm 40 begins at sample-extracting step 42, at which a respective sequence of samples is extracted from each audio signal. Subsequently to extracting the samples, the processor, at a second directional-signal-computing step 43, computes, from the extracted samples, respective directional signals for the predefined directions.

Typically, to avoid aliasing, the number of samples in each extracted sequence is greater than the number K of samples in each directional signal. In particular, at each iteration, the processor extracts a sequence $Y_i$ of the 2K most recent samples from each $i^{th}$ audio signal. Subsequently, the processor computes the FFT $Z_i$ of each sequence $Y_i$($Z_i$=FFT($Y_i$)). Next, for each $n^{th}$ predefined direction, the processor:

(a) computes the sum $\Sigma_i Z_i \cdot * B_i^n$, where (i) $B_i^n$ is a vector of beamforming coefficients (of length 2K) for the $i^{th}$ audio signal and $n^{th}$ direction, and (ii) "·*" indicates component-wise multiplication, and (b) computes the directional signal $X_n$ as the latter K elements of the inverse FFT of the aforementioned sum ($X_n = X_n'[K:2K-1]$, where $X_n' = \mathrm{IFFT}(\Sigma_i * B_i^n)$).

(Alternatively, as noted above with reference to FIG. 1, the directional signals may be computed by applying the FIR filter of the beamforming coefficients to $\{Y_i\}$ in the time domain.)

Algorithm 40 is typically executed periodically with a period T equal to K/f, where f is the sampling frequency with which the analog microphone signals are sampled by the processor while digitizing the signals. $X_n$ spans the time period spanned by the middle K samples of each sequence $Y_i$. (There is thus a lag of approximately K/2f between the end of the time period spanned by $X_n$ and the computation of $X_n$.)

Typically, T is between 2-10 ms. As a purely illustrative example, T may be 4 ms, f may be 16 kHz, and K may be 64.

Next, the processor calculates, at an energy-measure-calculating step 44, respective energy measures for the directional signals.

Subsequently to calculating the energy measures, the processor checks, at a first checking step 46, whether any one of the energy measures passes one or more predefined energy thresholds. If no energy measure passes the thresholds, the current iteration of algorithm 40 ends. Otherwise, the processor proceeds to a measure-selecting step 48, at which the processor selects the highest energy measure passing the thresholds that has not been selected yet. The processor then checks, at a second checking step 50, whether the listening device is already listening in the direction for which the selected energy measure was calculated. If not, the direction is added, at a direction-adding step 52, to a list of directions.

Subsequently, or if the listening device is already listening in the direction for which the selected energy measure was calculated, the processor checks, at a third checking step 54, whether any more energy measures should be selected. For example, the processor may check whether (i) at least one other not-yet-selected energy measure passes the thresholds, and (ii) the number of directions in the list is less than the maximum number of simultaneous listening directions. The maximum number of simultaneous listening directions, which is typically one or two, may be a hardcoded parameter, or it may be set by the user, e.g., using a suitable interface belonging to pod 21 (FIG. 1).

If the processor ascertains that another energy measure should be selected, the processor returns to measure-selecting step 48. Otherwise, the processor proceeds to a fourth checking step 56, at which the processor checks whether the list contains at least one direction. If not, the current iteration ends. Otherwise, the processor, at a third speech-similarity-score-calculating step 58, calculates a speech-similarity score, based on one of the directional signals.

Subsequently to calculating the speech-similarity score, the processor checks, at a fifth checking step 60, whether the speech-similarity score passes a predefined speech-similarity threshold. For example, for embodiments in which a higher score indicates greater similarity, the processor may check whether the speech-similarity score exceeds the threshold. If yes, the processor, at a second directing step 62, directs the listening device to at least one of the directions in the list. For example, the processor may output the directional signal, corresponding to one of the directions in the list, that was already calculated, or the processor may generate a new directional signal for one of the directions in the list using different beamforming coefficients. Subsequently, or if the speech-similarity score does not pass the threshold, the iteration ends.

Typically, if the list contains a single direction, the speech-similarity score is computed for the directional signal corresponding to the single direction in the list. If the list contains multiple directions, the speech-similarity score may be computed for any one of the directional signals corresponding to these directions, or for the directional signal corresponding to a current listening direction. Alternatively, a respective speech-similarity score may be computed for each of the directions in the list, and the listening device may be directed to each of these directions provided that the speech-similarity score for the direction passes the speech-similarity threshold, or provided that a speech-energy score for the direction—computed, for example, by multiplying the speech-similarity score for the direction by the energy measure for the direction—passes a speech-energy threshold.

Typically, a listening direction is dropped, even without replacement with a new listening direction, if the energy measure for the listening direction does not pass the energy thresholds for a predefined threshold period of time (e.g., 2-10 s). In some embodiments, the listening direction is dropped only if at least one other listening direction remains.

It is emphasized that algorithm 40 is provided by way of example only. Other embodiments may reorder some of the steps in algorithm 40, and/or add or remove one or more steps. For example, the speech-similarity score, or respective speech-similarity scores for the directional signals, may be calculated prior to calculating the energy measures. Alternatively, no speech-similarity scores may be calculated at all, and the listening direction(s) may be selected in response to the energy measures w considering whether the corresponding directional signals appear to represent speech.

Calculating the Energy Measures and Thresholds

In some embodiments, the energy measures calculated during the execution of algorithm 25 (FIG. 2), algorithm 35 (FIG. 3), algorithm 40 (FIG. 4), or any other suitable speech-tracking algorithm implementing the principles described herein, are based on respective time-averaged acoustic energies of the channels over a period of time. For example, the energy measures may be equal to the time-averaged acoustic energies. Typically, the time-averaged acoustic energy for each channel $X_n$ is calculated as a running weighted average, e.g., as follows:

(i) Calculate the energy $E_n$ of $X_n$. This calculation may be performed in the time domain, e.g., per the formula $E_n=\Sigma_{i=1}^{K-1}(X_n[i]-X_n[i-1])^2$. Alternatively, the calculation of $E_n$ may be performed in the frequency domain, optionally giving greater weight to typical speech frequencies such as frequencies within a range of 100-8000 Hz.

(ii) Calculate the time-averaged acoustic energy as $S_n=\alpha E_n+(1-\alpha)S_n'$, where $S_n'$ is the time-averaged acoustic energy for $X_n$ calculated during be previous iteration (i.e., the time-averaged acoustic energy of the previous sequence of samples extracted from $X_n$) and $\alpha$ is between 0 and 1. (The period of time over which $S_n$ is calculated thus begins at the time corresponding to the first sample extracted from $X_n$ during the first iteration of the algorithm, and ends at the time corresponding to the last sample extracted from $X_n$ during the present iteration.)

In some embodiments, one of the energy thresholds is based on a time-averaged acoustic energy $L_m$ for the $m^{th}$ channel, where the $m^{th}$ direction is a current listening direction different from the n direction. (In case there are multiple current listening directions, $L_m$ is typically the lowest time-averaged acoustic energy from among all the current listening directions.) For example, the threshold may equal a multiple of $L_m$ and a constant $C_1$. $L_m$ is typically calculated as described above for $S_n$; however, $L_m$ gives greater weight to earlier portions of the period of time relative to $S_n$, by virtue of a being closer to 0. (As a purely illustrative example, $\alpha$ may be 0.1 for $S_n$ and 0.005 for $L_m$.) Thus, $L_m$, may be thought of a "long-term time-averaged energy," and $S_n$ as a "short-term time-averaged energy."

Alternatively or additionally, one of the energy thresholds may be based on an average of the short-term time-averaged acoustic energies, $$\text{i.e., } \frac{1}{N}\sum_{i=1}^{N} S_i$$

where N is the number of channels. For example, the threshold may equal a multiple of this average and another constant $C_2$.

Alternatively or additionally, one of the energy thresholds may be based on an average of the long-term time-averaged acoustic energies, $$\text{i.e., } \frac{1}{N}\sum_{i=1}^{N} L_i.$$

For example, the threshold may equal a multiple of this average and another constant $C_3$.

Calculating the Speech-Similarity Score

In some embodiments, each speech-similarity score calculated during the execution of algorithm 25 (FIG. 2), algorithm 35 (FIG. 3), algorithm 40 (FIG. 4), or any other suitable speech-tracking algorithm implementing the principles described herein, is calculated by correlating coefficients representing the spectral envelope of a channel $X_n$ with other coefficients representing a canonical speech spectral envelope, which represents the average spectral properties of speech in a particular language (and, optionally, dialect). The canonical speech spectral envelope, which may also be referred to as a "universal" or "representative" speech spectral envelope, may be derived, for example, from a long-term average speech spectrum (LTASS) described in Byrne, Denis, et al., "An international comparison of long-term average speech spectra," The journal of the acoustical society of America 96.4 (1994): 2108-2120, which is incorporated herein by reference.

Typically, the canonical coefficients are stored in memory 38 (FIG. 1). In some embodiments, memory 38 stores multiple sets of canonical coefficients corresponding to different respective languages (and, optionally, dialects), In such embodiments, the user may indicate, using suitable controls in listening device 20, the language (and, optionally, dialect) to which the listened-to speech belongs, and in response thereto, the processor may select the appropriate canonical coefficients.

In some embodiments, the coefficients of the spectral envelope of $X_n$ include mel frequency cepstral coefficients (MFCCs). These may be calculated, for example, by (i) calculating the Welch spectrum of the FFT of $X_n$ and eliminating any direct current (DC) component thereof, (ii) transforming the Welch spectrum from a linear frequency scale to a mel-frequency scale, using a linear-to-mel filter bank, (iii) transforming the mel-frequency spectrum to a decibel scale, and (iv) calculating the MFCCs as the coefficients of a discrete cosine transform (DCT) of the transformed mel-frequency spectrum.

In such embodiments, the coefficients of the canonical envelope also include MFCCs. These may be calculated, for example, by eliminating the DC component from an LTASS, transforming the resulting spectrum to a mel-frequency scale as in step (ii) above, transforming the mel-frequency spectrum to a decibel scale as in step (iii) above, and calculating the MFCCs as the coefficients of the DCT of the transformed met-frequency spectrum as in step (iv) above. Given the set $M_X$ of MFCCs of $X_n$ and the corresponding set $M_C$ of canonical MFCCs, the speech-similarity score may be calculated as $\Sigma_i M_X[i]M_C[i]/\sqrt{\Sigma_i M_X[i]^2 \Sigma_i M_C[i]^2}$.

Listening in Multiple Directions Simultaneously

In some embodiments, the processor may direct the listening device to multiple directions simultaneously. In such embodiments, the processor—e.g., in channel-outputting step 33 (FIG. 2), first directing step 45 (FIG. 3), or second directing step 62 (FIG. 4) may add a new listening direction to a current listening direction. In other words, the processor may cause the listening device to output a combined signal representing both directions with greater weight, relative to other directions. Alternatively, the processor may replace one of multiple current listening directions with the new direction.

In the event that a single direction is to be replaced, the processor may replace the listening direction having the minimum time-averaged acoustic energy over a period of time, such as the minimum short-term time-averaged acoustic energy. In other words, the processor may identify the minimum time-averaged acoustic energy for the current listening directions, and then replace the direction for which the minimum was identified.

Alternatively, the processor may replace the current listening direction that is most similar to the new direction, based on the assumption that a speaker previously speaking from the former direction is now speaking from the latter direction. For example, given a first current listening direction oriented at 0 degrees, a second current listening direction oriented at 90 degrees, and a new direction oriented at 80 degrees, the processor may replace the second current listening direction with the new direction (even if the energy from the second current listening direction is greater than the energy from the first current listening direction), since $|80-90|=10$ is less than $|80-0|=80$.

In some embodiments, the processor directs the listening device to multiple listening directions by summing the respective combined signals for the listening directions. Typically, in this summation, each combined signal is weighted by its relative short-term or long-term time-averaged energy. For example, given two combined signals $X_{n1}$ and $X_{n2}$, the combined signal for output may be calculated as $$\frac{S_{n1}}{S_{n1}+S_{n2}}X_{n1}+\frac{S_{n2}}{S_{n1}+S_{n2}}X_{n2}$$

or $$\frac{L_{n1}}{L_{n1}+L_{n2}}X_{n1}+\frac{L_{n2}}{L_{n1}+L_{n2}}X_{n2}.$$

In other embodiments, the processor directs the listening device to multiple listening directions by combining the audio signals using a single set of beamforming coefficients that corresponds to the combination of the multiple listening directions.

Indicating the Listening Direction(S)

Typically, the processor indicates each current listening direction to the user(s) of the listening device. For example, multiple indicator lights 30 (FIG. 1) may correspond to the predefined directions, respectively, such that the processor may indicate the listening direction by activating the corresponding indicator light. Alternatively, the processor may cause the listening device to display, on a suitable screen, an arrow pointing in the listening direction.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

The invention claimed is:

1. A system, comprising:

a plurality of microphones, configured to generate different respective signals in response to acoustic waves arriving at the microphones; and a processor, configured to:

receive the signals, using multiple sets of beamforming coefficients corresponding to different respective directional responses oriented in different respective directions relative to the microphones, combine the signals into multiple channels, which correspond to the directions, respectively, by virtue of each channel representing any portion of the acoustic waves arriving from the corresponding direction with greater weight, relative to others of the directions, calculate respective energies of the channels, select one of the directions, in response to the energy of the channel corresponding to the selected direction exceeding one or more predefined energy thresholds, and output a combined signal representing the selected direction with greater weight, relative to others of the directions.

2. The system according to claim 1, wherein the combined signal is the channel corresponding to the selected direction.

3. The system according to claim 1, wherein the processor is further configured to indicate the selected direction to a user of the system.

4. The system according to claim 1, wherein the processor is further configured to calculate one or more speech-similarity scores for one or more of the channels, respectively, each of the speech-similarity scores quantifying a degree to which a different respective one of the channels appears to represent speech, and wherein the processor is configured to select the one of the directions in response to the speech-similarity scores.

5. The system according to claim 4, wherein the processor is configured to calculate each of the speech-similarity scores by correlating first coefficients, which represent a spectral envelope of one of the channels, with second coefficients, which represent a canonical speech spectral envelope.

6. The system according to claim 1, wherein the processor is further configured to identify the directions using a direction-of-arrival (DOA) identifying technique.

7. The system according to claim 1, wherein the directions are predefined.

8. The system according to claim 1, wherein the processor is configured to calculate respective time-averaged acoustic energies of the channels, respectively, over a period of time, and wherein the processor is configured to select the one of the directions in response to the time-averaged acoustic energy of the channel corresponding to the selected direction exceeding the predefined energy thresholds.

9. The system according to claim 8, wherein the time-averaged acoustic energies are first time-averaged acoustic energies, wherein the processor is configured to receive the signals while outputting another combined signal corresponding to another one of the directions, and wherein at least one of the energy thresholds is based on a second time-averaged acoustic energy of the channel corresponding to the other one of the directions, the second time-averaged acoustic energy giving greater weight to earlier portions of the period of time relative to the first time-averaged acoustic energies.

10. The system according to claim 8, wherein at least one of the energy thresholds is based on an average of the time-averaged acoustic energies.

11. The system according to claim 8, wherein the time-averaged acoustic energies are first time-averaged acoustic energies, wherein the processor is further configured to calculate respective second time-averaged acoustic energies of the channels over the period of time, the second time-averaged acoustic energies giving greater weight to earlier portions of the period of time, relative to the first time-averaged acoustic energies, and wherein at least one of the energy thresholds is based on an average of the second time-averaged acoustic energies.

12. The system according to claim 1, wherein the selected direction is a first selected direction and the combined signal is a first combined signal, and wherein the processor is further configured to:

select a second one of the directions, and output, instead of the first combined signal, a second combined signal representing both the first selected direction and the second selected direction with greater weight, relative to others of the directions.

13. The system according to claim 12, wherein the processor is further configured to:

select a third one of the directions, ascertain that the second selected direction is more similar to the third selected direction than is the first selected direction, and output, instead of the second combined signal, a third combined signal representing both the first selected direction and the third selected direction with greater weight, relative to others of the directions.

14. A method, comprising:

receiving, by a processor, a plurality of signals from different respective microphones, the signals being generated by the microphones in response to acoustic waves arriving at the microphones;

using multiple sets of beamforming coefficients corresponding to different respective directional responses oriented in different respective directions relative to the microphones, combining the signals into multiple channels, which correspond to the directions, respectively, by virtue of each channel representing any portion of the acoustic waves arriving from the corresponding direction with greater weight, relative to others of the directions;

calculating respective energies of the channels;

selecting one of the directions, in response to the energy of the channel corresponding to the selected direction exceeding one or more predefined energy thresholds; and outputting a combined signal representing the selected direction with greater weight, relative to others of the directions.

15. The method according to claim 14, wherein the combined signal is the channel corresponding to the selected direction.

16. The method according to claim 14, further comprising indicating the selected direction to a user of the microphones.

17. The method according to claim 14, further comprising calculating one or more speech-similarity scores for one or more of the channels, respectively, each of the speech-similarity scores quantifying a degree to which a different respective one of the channels appears to represent speech, wherein selecting the one of the directions comprises selecting the one of the directions in response to the speech-similarity scores.

18. The method according to claim 17, wherein calculating the one or more speech-similarity scores comprises calculating each of the speech-similarity scores by correlating first coefficients, which represent a spectral envelope of one of the channels, with second coefficients, which represent a canonical speech spectral envelope.

19. The method according to claim 14, further comprising ascertaining the directions using a direction-of-arrival (DOA) identifying technique.

20. The method according to claim 14, wherein the directions are predefined.

21. The method according to claim 14, wherein calculating the energies comprises calculating respective time-averaged acoustic energies of the channels, respectively, over a period of time, and wherein selecting the one of the directions comprises selecting the one of the directions in response to the time-averaged acoustic energy of the channel corresponding to the selected direction exceeding the predefined energy thresholds.

22. The method according to claim 21, wherein the time-averaged acoustic energies are first time-averaged acoustic energies, wherein receiving the signals comprises receiving the signals while outputting another combined signal corresponding to another one of the directions, and wherein at least one of the energy thresholds is based on a second time-averaged acoustic energy of the channel corresponding to the other one of the directions, the second time-averaged acoustic energy giving greater weight to earlier portions of the period of time relative to the first time-averaged acoustic energies.

23. The method according to claim 21, wherein at least one of the energy thresholds is based on an average of the time-averaged acoustic energies.

24. The method according to claim 21, wherein the time-averaged acoustic energies are first time-averaged acoustic energies, wherein the method further comprises calculating respective second time-averaged acoustic energies of the channels over the period of time, the second time-averaged acoustic energies giving greater weight to earlier portions of the period of time, relative to the first time-averaged acoustic energies, and wherein at least one of the energy thresholds is based on an average of the second time-averaged acoustic energies.

25. The method according to claim 14, wherein the selected direction is a first selected direction and the combined signal is a first combined signal, and wherein the method further comprises:

selecting a second one of the directions; and outputting, instead of the first combined signal, a second combined signal representing both the first selected direction and the second selected direction with greater weight, relative to others of the directions.

26. The method according to claim 25, further comprising:

selecting a third one of the directions;

ascertaining that the second selected direction is more similar to the third selected direction than is the first selected direction; and outputting, instead of the second combined signal, a third combined signal representing both the first selected direction and the third selected direction with greater weight, relative to others of the directions.

27. A computer software product comprising a tangible non-transitory computer-readable medium in which program instructions are stored, which instructions, when read by a processor, cause the processor to:

receive, from a plurality of microphones, respective signals generated by the microphones in response to acoustic waves arriving at the microphones, using multiple sets of beamforming coefficients corresponding to different respective directional responses oriented in different respective directions relative to the microphones, combine the signals into multiple channels, which correspond to the directions, respectively, by virtue of each channel representing any portion of the acoustic waves arriving from the corresponding direction with greater weight, relative to others of the directions, calculate respective energies of the channels, select one of the directions, in response to the energy of the channel corresponding to the selected direction exceeding one or more predefined energy thresholds, and output a combined signal representing the selected direction with greater weight, relative to others of the directions.

* * * * *